United States Patent [19]

Aldorfer

[11] 4,036,016

[45] July 19, 1977

[54] VACUUM-OPERATED RECIPROCATING ENGINE

[76] Inventor: Louis Aldorfer, 144-8th Ave. S. No. 2, South Saint Paul, Minn. 55075

[21] Appl. No.: 735,054

[22] Filed: Oct. 22, 1976

Related U.S. Application Data

[63] Continuation-in-part of Ser. No. 629,138, Nov. 5, 1975, abandoned.

[51] Int. Cl.[2] ..... F16D 31/02

[52] U.S. Cl. ..... 60/325; 60/407; 123/1 R

[58] Field of Search ..... 60/397, 497, 407, 325, 60/398; 123/1 R, 38

[56] References Cited

U.S. PATENT DOCUMENTS

| | | | |
|---|---|---|---|
| 124,520 | 3/1872 | Tuttle | 123/38 |
| 195,585 | 9/1877 | Dieckmann | 123/38 |
| 221,961 | 11/1879 | Goldmann | 123/38 |
| 236,258 | 1/1881 | Rauel | 123/38 X |
| 439,222 | 10/1890 | Widerman | 123/38 |
| 1,112,956 | 10/1914 | White et al. | 60/325 X |
| 2,054,570 | 9/1936 | Burt | 60/407 X |
| 2,484,183 | 10/1949 | Paulson | 60/398 |
| 3,925,986 | 12/1975 | Barwick | 60/398 |

*Primary Examiner*—Carroll B. Dority, Jr.
*Assistant Examiner*—Ira S. Lazarus
*Attorney, Agent, or Firm*—Norman P. Friederichs

[57] ABSTRACT

A reciprocating engine utilizes the pressure difference between a partial vacuum and the ambient atmospheric pressure as a source of power. The engine includes an engine block defining a plurality of cylinders each having a piston operating within it. The first or outer face of each piston is maintained substantially at atmospheric pressure while the second or inner face of each piston is maintained at less than ambient atmospheric pressure during the power stroke of the piston by connection to a flame-free vacuum source. Once each piston has reached the end of this power stroke due to the pressure difference across the piston, a limited amount of air is permitted to enter the respective cylinder adjacent the second or inner face of the piston to thereby return the second face of the piston to substantially atmospheric pressure. With the pressure on both faces of the piston being substantially equalized, the piston is permitted to return to the beginning of its power stroke by rotation of an output or crankshaft which is being rotated by action of a different piston. Upon reaching the beginning of its power stroke, the air inlet is cut off and the flame-free vacuum means again applied to return the second face of the piston to a pressure less than the ambient atmospheric pressure to thereby re-establish the pressure difference across the piston, resulting in the power stroke of the piston. Output means including an output shaft are operatively connected to the pistons to translate the reciprocating motion of the pistons into rotary motion of the output shaft. The output shaft carries a flywheel and the inertial effects of the flywheel are utilized to return each piston from the end of its power stroke to the beginning of its power stroke.

9 Claims, 2 Drawing Figures

10
11
15
14
13
30
33
31
32
29
29
29
29
28
27
12
47
47
47
47
WATER
LEVEL
34
38
36
37
35

VACUUM-OPERATED RECIPROCATING ENGINE

CROSS-REFERENCE TO RELATED APPLICATION

This application is a continuation-in-part of my copending application Ser. No. 629,138, filed on Nov. 5, 1975, now abandoned, and entitled ARP ENGINE.

BACKGROUND OF THE INVENTION

1. Field of the Invention

This invention relates to a reciprocating engine which utilizes the pressure difference between a partial vacuum generated by a flame-free vacuum means and the ambient atmospheric pressure as a source of power.

2. Description of the Prior Art

It has been known to utilize cyclic or periodic pressure differences between a partial vacuum and the ambient atmosphere applied across a piston as a power source to operate an engine. Various methods have been suggested for creating this pressure difference and many of them have involved combustion of a fuel. In one proposed system, a combustible fuel is periodically burned within the cylinder adjacent the low pressure side of the piston to create a partial vacuum on that side of the piston as the fuel is consumed, resulting in a pressure difference across the piston which causes the power stroke. Upon completion of the power stroke, air is admitted into the cylinder adjacent the low pressure face of the piston to substantially equalize the pressure across the piston and permit it to return to the beginning of its power stroke where the cycle begins again.

The disadvantages with these types of systems are self-apparent. The systems tend to be complex and some sort of combustible fuel as well as an ignition source to ignite the fuel are required. These disadvantages have become increasingly negative during the recent energy crisis and fuel shortages.

SUMMARY OF THE INVENTION

The present invention solves problems associated with the prior art devices. A vacuum is created without the direct use of a fuel and the associated ignition means.

The present invention includes an engine block which defines a plurality of cylinders each having an inner, low-pressure, end and an outer, high-pressure, end. Each cylinder has a piston operating within it having a first face operating within an outer region adjacent the outer, high-pressure, end of its respective cylinder and and a second face operating within an inner region adjacent the inner, low-pressure, end. The outer region is maintained at ambient atmospheric pressure while the inner region is sealed from the ambient atmosphere. Each piston operates within its respective cylinder between a first position wherein the inner region is minimized and the outer region is maximized, and a second position wherein the inner region is maximized and the outer region is minimized. A partial vacuum is cyclically applied to the second face of each cylinder to move it from the second position to the first position. This is referred to as the power stroke of the piston.

A flame-free vacuum means selectively and cyclically reduces the pressure within the inner regions of each cylinder to a pressure less than that of the ambient atmosphere. The second face of the respective piston is thereby periodically maintained at less than ambient atmospheric pressure, resulting in a cyclic pressure difference across the piston creating the power stroke of the piston.

Means are provided for disconnecting the vacuum means from each cylinder upon completion of the respective piston's power stroke and for permitting the intake of a limited amount of ambient air into the inner region of the cylinder adjacent the second face of the piston. The pressure difference across the piston is thereby eliminated, permitting the piston to return from its first position to its second position to repeat the power stroke when the vacuum means is re-applied.

A rotating output shaft is operatively connected to the pistons. The vacuum means and the means for controlling application of the vacuum operate in timed relation to the rotating output shaft in such a manner that a pressure difference is caused to exist across each piston as it operates from its second position to its first position by application of the vacuum means, and that no significant pressure difference exists across the piston as it operates from its first position to its second position due to disconnection of the vacuum means and the intake of air into the inner region of the cylinder.

The position of the pistons in each cylinder is maintained in a fixed staggered arrangement such that approximately one half of the pistons will be at various stages in their power stroke while the other pistons are at various stages in their return stroke at any given time. In this manner, the power stroke of a portion of the pistons is utilized to power the return stroke of the remainder of the pistons. A flywheel is preferably attached to the output shaft so that its inertial effect may be utilized to assist in the return stroke of the pistons and to create smooth operation of the engine.

In one embodiment, the vacuum means is a water hydraulic source which may consist of a storage tank which is filled with water to dispel the air of other gases. The tank is then closed and the water is removed from the tank due to force of gravity until the water column within the tank reaches a stabilized height dictated by the ambient atmospheric pressure. This will create a vacuum, or sub-atmospheric pressure zone, within the tank before the water level and this reduced pressure may be tapped to operate the engine. As the air taken into each cylinder during the return stroke of its piston is drawn into the vacuum tank, the pressure above the water column will slowly increase resulting in a lowering in height of the water column. As the partial vacuum within the tank approaches the pressure of the ambient atmosphere, the tank will drain completely and may be refilled with water to re-create a vacuum source. By providing a tank of large dimensions in comparison to the displacement of the cylinders, the time interval between successive fillings of the tank with water may be made sufficiently long to provide for prolonged operation of the engine.

The above-described embodiment is particularly useful in locations having a natural drop in elevation of a body of water (i.e., a waterfall). Water may be added to the vacuum tank at the higher level and drained from the tank at the lower level. Due to the advantages of using a large vacuum tank, the engine will preferably be stationary. The engine is particularly useful for light factory work and the generation of electricity.

Other vacuum sources can be used, if desired.

DETAILED DESCRIPTION OF THE PREFERRED EMBODIMENT

Figure 1:
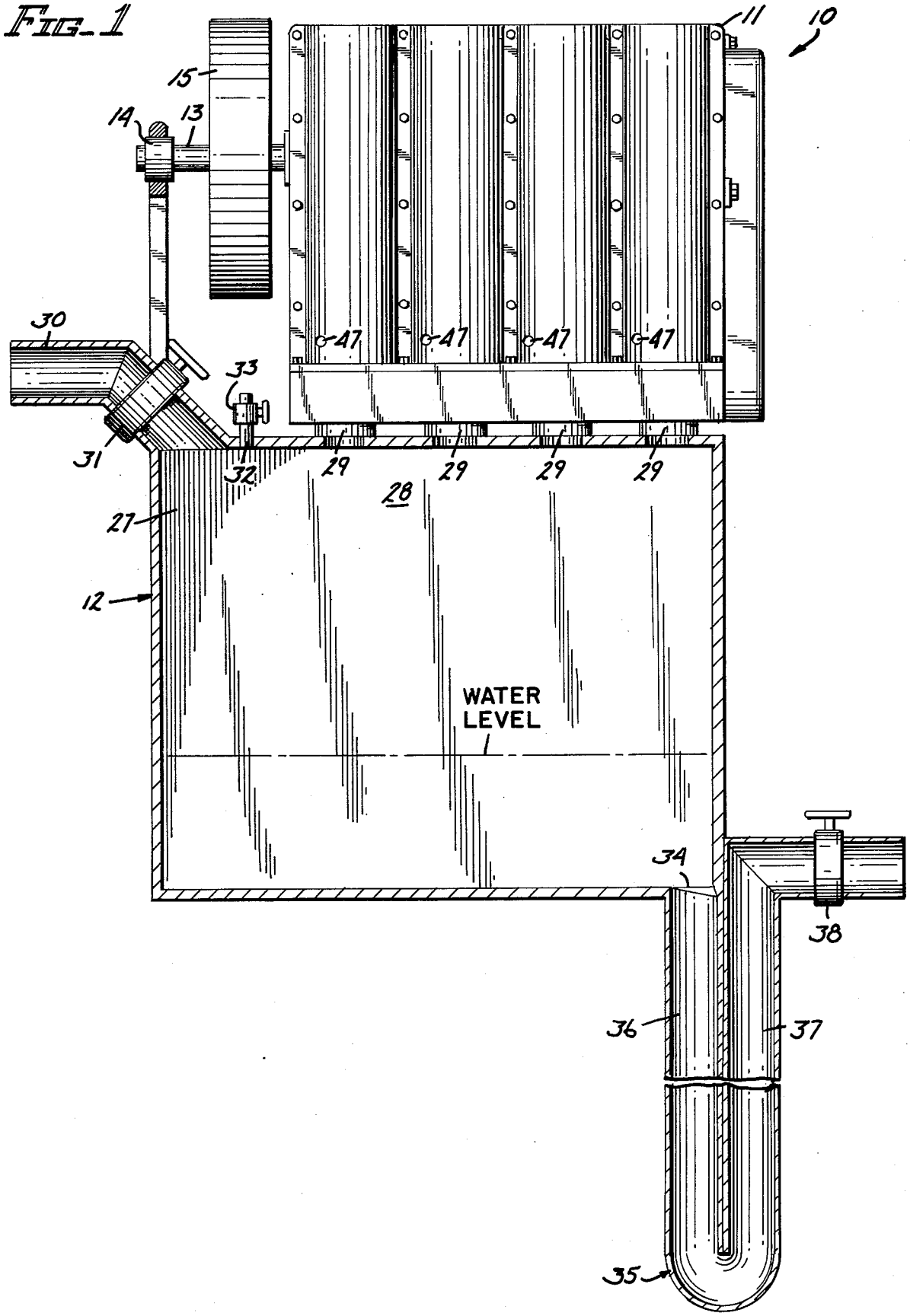
FIG. 1 is a view in side elevation of a flame-free reciprocating engine with portions thereof shown in section.

Referring to FIG. 1, a flame-free reciprocating engine is generally designated at 10. The engine 10 includes an engine block 11 positioned above a vacuum source generally designated at 12. A rotatable output shaft 13 extends exteriorally of the engine block 11 and is journaled in support 14. A flywheel 15 is attached to the output shaft 13 for rotation therewith. The significance of the flywheel is described below.

Figure 2:
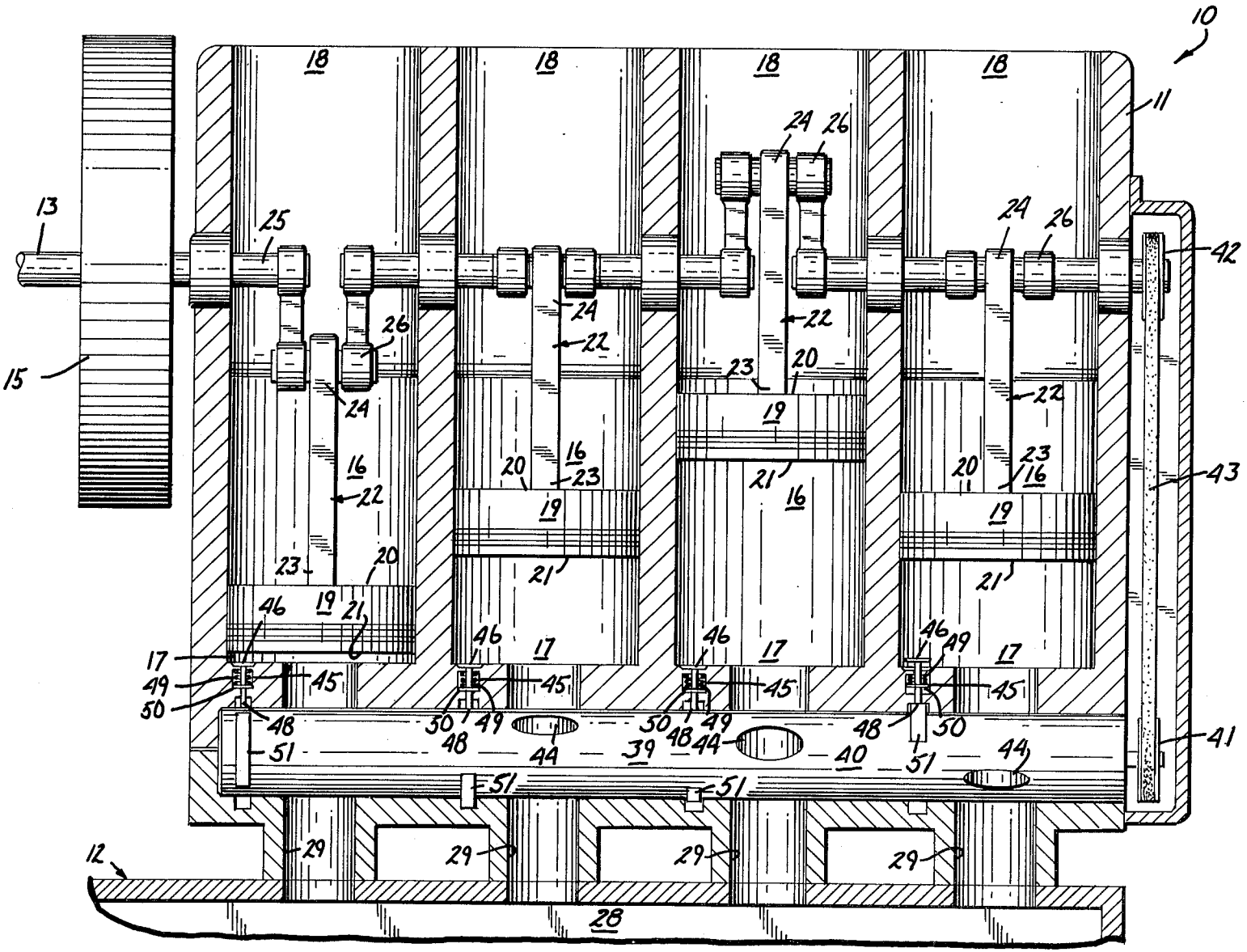
FIG. 2 is a sectional view of a portion of the flame-free reciprocating engine shown in FIG. 1.

Referring to FIG. 2, the engine block 11 defines a plurality of cylinders 16. The cylinders 16 each have an inner, low-pressure, end 17 and an outer, high-pressure, end 18. A piston 19 slidably operates within each of the cylinders 16, as is well known. Each piston 19 has a first, outer face 20 and a second, inner face 21. The first, outer face 20 operates within an outer region positioned on that side of the piston 19 adjacent the outer end 18, while the second, inner face 21 operates within an inner region positioned on that side of the piston 19 adjacent the inner end 17 of the cylinder 16. The piston 19 seals the inner region from the outer region. The outer region of each cylinder 16 is maintained at the pressure of the ambient atmosphere by communication with the ambient atmosphere. The inner region is normally sealed from the ambient atmosphere.

Each of the pistons 19 is attached to a first end 23 of a piston rod 22. The second ends 24 of the piston rods 22 are operatively connected to one each of a plurality of throws 26 of a crankshaft 25. The crankshaft 25 is journaled for rotation within the engine block 11 and is operatively connected to the output shaft 13. The rotation of the crankshaft 25 due to the sliding, reciprocating motion of the pistons 19 within the cylinders 16 is translated to rotary motion of the output shaft 13 and the flywheel 15.

The vacuum source 12 communicates with the inner region of each of the cylinders 16 adjacent the second face 21 of the pistons 19 for selectively reducing the pressure within the inner region of each cylinder 16 to a pressure less than atmospheric pressure. The second face 21 of a piston 19 will thus periodically be maintained at less than atmospheric pressure, resulting in a cyclic pressure difference across the piston 19.

Referring to FIG. 1, the vacuum source 12 includes a vacuum tank 27 positioned beneath the engine block 11. A zone of sub-atmospheric pressure, generally designated at 28, is maintained within the vacuum tank 27. The inner regions of the cylinders 16 communicate with the sub-atmospheric pressure zone 28 through conduits 29, as seen in FIG. 2.

The operation of the vacuum source 12 in the preferred embodiment is best described with reference to FIG. 1. The vacuum tank 27 is positioned immediately below and supports the engine block 11. A water inlet 30 permits the delivery of water to the vacuum tank 27 from a water source (not shown). The water inlet 30 will generally consist of conduit or piping suitable for transporting sufficient quantities of water from a river or the like to the vacuum tank 27. A water inlet cutoff valve 31 is connected to the water inlet 30 to cut off delivery of water to the vacuum tank 27 once the vacuum tank 27 has been filled with water.

As water is transported to the vacuum tank 27 through the water inlet 30, air within the vacuum tank 27 is permitted to evacuate through a gas outlet 32 positioned at the top of the vacuum tank 27. The gas outlet 32 may take any form sufficient to permit the passage of air therethrough. A closure valve 33 is provided to close the gas outlet 32 upon the evacuation of all air from within the vacuum tank 27. When the closure valve 33 is closed, airflow into the vacuum tank 27 will be prevented as the water level within the tank is lowered.

A water outlet, generally designated at 34, is provided near the bottom of the vacuum tank 27 to permit the evacuation of water from within the vacuum tank 27 by force of gravity. It is preferred that the water outlet 34 include a conduit 35 attached at one end to the vacuum tank 27 and having a first portion 36 extending downwardly from the vacuum tank 27 and a second portion 37 attached to the first portion 36 oppositely of the vacuum tank 27 and extending upwardly to approximately the same elevation as the connection between the first portion 36 of the conduit 35 and the vacuum tank 27. This particular configuration of the conduit 35 will prevent the passage of air into the vacuum tank 27 through the water outlet 34 when a partial vacuum is maintained above the water column within the vacuum tank 27. A water outlet valve 38 is operatively connected to the second portion 37 to close the water outlet 34 and thus prevent passage of water through the water outlet 34 while the vacuum tank 27 is being filled with water. The water outlet valve 38 is otherwise kept open.

In operation, a sub-atmospheric pressure zone 28 is created as follows. The water outlet valve 38 is closed to prevent evacuation of water from within the vacuum tank 27. The closure valve 33 for the gas outlet 32 is opened to permit the evacuation of air from the vacuum tank 27. The water inlet cutoff valve 31 is thereupon opened to permit the passage of water from the water source through the water inlet 30 and into the vacuum tank 27. As water is delivered to the vacuum tank 27, the water level within the tank rises resulting in the evacuation of air from the vacuum tank 27 through the gas outlet 32. This continues until the vacuum tank 27 is filled with water. With essentially all of the air evacuated from within the vacuum tank 27, the closure valve 33 may be closed to shut off the gas outlet 32. Air will thus be prevented from re-entering the vacuum tank 27 as the water is evacuated therefrom. The water inlet cutoff valve 31 is also closed to prevent further passage of water into the vacuum tank 27.

With all modes of entrance for both liquid and gas into the vacuum tank 27 thus effectively sealed, the water outlet valve 38 is opened to permit the evacuation of the water within the vacuum tank 27 through the water outlet 34. As the water level within the vacuum tank 27 is lowered due to the weight of the water, a sub-atmospheric pressure zone 28 will be created above the water. According to well known principles of physics, the height of the water column within the vacuum tank 27 will stabilize at a height dictated by the pressure of the ambient atmosphere. This is a result of the fact that a reduced pressure zone exists above the water. The sub-atmospheric pressure zone 28 existing above the water within the vacuum tank 27 may be thereupon utilized to create a pressure difference across the pistons 19 within the cylinder 16, as will be subsequently described.

While a particular type of flame-free vacuum source has been described, it will be understood that other flame-free vacuum sources may work equally as well within the spirit and scope of this invention. The important aspect of this feature of the invention resides in the creation of a sub-atmospheric pressure which may be applied to the inner regions of the cylinders 16 to selectively create a pressure difference across the pistons 19.

It is necessary that the pressure difference across the piston 19 be removed as the piston operates from its first position to its second position, referred to as the return stroke of the piston 19. To accomplish this, communication between the sub-atmospheric pressure zone 28 and the inner region of each respective cylinder 16 is closed during the return stroke of the piston 19 by valve means operatively connected to the output shaft 13 to operate in timed relation to the operation of the pistons 19 within the cylinders 16. The second step in eliminating the pressure difference across a piston 19 during its return stroke is to establish a pressure within the inner region of the respective cylinder 16 which is generally equal to the pressure of the ambient atmosphere. This is accomplished by permitting the intake of a limited amount of ambient air into the inner region of the cylinder 16.

To cut off communication between the inner region of the cylinder 16 and the sub-atmospheric pressure zone 28, a rotating shaft valve generally designated at 39 is journaled for rotation within the engine block 11 to interrupt the conduits 29 connecting the sub-atmospheric pressure zone 28 with the inner regions of the cylinders 16. The rotating shaft valve 39 includes a cylindrical shaft 40 journaled within the engine block 11. A pulley 41 is operatively connected to one end of the cylindrical shaft 40 as seen in FIG. 2. A second pulley 42 is attached to the output shaft 13 and operatively connected to the pulley 41 by means of a timing belt 43.

A plurality of ports 44 extending at right angles to the longitudinal axis of the cylindrical shaft 40 are provided through the cylindrical shaft 40 at the positions where the shaft 40 interrupts the conduits 29. While the shaft 40 interrupts communication between the sub-atmospheric pressure zone 28 and the inner regions of the cylinders 16, when the ports 44 are aligned with the conduits 29 communication will be re-established between the sub-atmospheric pressure zone 28 and the inner region of the cylinders 16. By choosing the proper orientation of the ports 44 through the shaft 40 relative to one another, communication between the sub-atmospheric pressure zone 28 and the inner region of a cylinder 16 wherein the piston 19 is operating on its power stroke may be established, while communication between the sub-atmospheric pressure zone 28 and the inner region of another cylinder 16 wherein the piston 19 is operating on its return stroke may be closed. The rotation of the shaft 40 may be timed to the operation of the pistons 19 within a cylinder 16 such that communication between the inner region of each cylinder 16 and the sub-atmospheric pressure zone 28 will be established only during the power stroke of the respective piston 19. Thus, the inner region of each cylinder 16 will be maintained at less than atmospheric pressure during the power stroke of its piston 19 resulting in a pressure difference across the piston 19 during its power stroke.

To permit the intake of a limited amount of air into the inner region of each cylinder 16 during the return stroke of its respective piston 19, an air intake valve generally designated at 45 is provided for each cylinder 16. Each air intake valve 45 comprises a valve 46 seated within its respective cylinder 16 to close communication between the ambient atmosphere and the inner region of each cylinder 16. When the valve 46 is unseated, the inner region of the respective cylinder 16 communicates with the ambient atmosphere through an opening 47, seen in FIG. 1.

Referring to FIG. 2, the valve 46 is attached to a first end of a valve stem 48 extending through the engine block 11 toward the cylindrical shaft 40. The valve 46 is spring-biased to seat within each cylinder 16 by means of a compression spring 49 which operates on a collar 50 attached around the valve stem 48 as seen in FIG. 2.

The valve stem 48 of each air intake valve 45 has a second end positioned adjacent the cylindrical shaft 40. The cylindrical shaft 40 carries a plurality of cam surfaces 51, one being located adjacent each of the second ends of the valve stems 48. As the cylindrical shaft 40 rotates in response to the operation of the pistons 19 within the cylinders 16, the cam surfaces 51 will engage the second end of the valve shaft 48 and unseat the valve 46 thereby permitting the intake of air into the inner region of each respective cylinder 16. The location of each of the cam surfaces 51 relative to the ports 44 on the cylindrical shaft 40 is chosen such that the second end of each valve stem 48 engages the respective cam surface 51 to unseat the valve 46 only at such times as communication between the inner region of the respective cylinder 16 and the sub-atmospheric pressure zone 28 is closed. The result, of course, is that air intake into the inner region of each respective cylinder 16 is permitted only as the respective piston 19 operates on its return stroke. Thus, the pressure within the inner region of the cylinder 16 is maintained at the pressure of the ambient atmosphere during the return stroke of each piston 19 thereby eliminating the pressure difference across the piston 19 during its return stroke.

The operation of one piston 19 within its respective cylinder 16 will be described herein, but it will be understood that the operation of the other pistons 19 within their respective cylinders 16 is exactly the same, keeping in mind that the position of the pistons 19 within the cylinders 16 is staggered such that approximately half of the pistons will be at varying stages during their return stroke while approximately one half are at varying stages during their power stroke.

Beginning with a piston 19 at its second position within the cylinder 16, a pressure difference exists across the piston 19 due to the fact that its first face 20 is maintained at atmospheric pressure while its second face 21 is maintained at less than atmospheric pressure due to communication between the sub-atmospheric pressure zone 28 and the inner region of the cylinder 16 adjacent the second face 21. As is well known, a pressure difference across the piston results in movement of the piston toward the low pressure side of the piston. Thus, the piston 19 will move from its second position toward its first position.

As the piston 19 reaches its first position, communication between the sub-atmospheric pressure zone 28 and the inner region of the cylinder 16 is closed by operation of the rotating shaft valve 39. Upon reaching its first position, the air intake valve 45 is opened by the unseating of the valve 46 in response to engagement of the valve stem 48 with the cam surface 51. As the air intake valve 45 opens, air is taken into the inner regions of the cylinders 16 due to the pressure difference between the ambient atmosphere and the inner region. The intake of air into the inner region of the cylinder 16 increases the pressure of the inner region until it is substantially equal to the ambient atmospheric pressure.

The return stroke of the piston 19 is in part the result of the inertial effect of the flywheel 15 to continue rotation of the output shaft 13, and thus the crankshaft 25. While the piston 19 is on its return stroke, other pistons 19 are on their power stroke which similarly continues the rotation of the crankshaft 25 to result in the return stroke of the piston 19. The significance of eliminating the pressure difference across the piston 19 is that no resistance to the return stroke is created upon the piston 19.

The return stroke continues until the piston 19 reaches its second position once again. Upon reaching the second position of the piston 19, communication is again re-established between the sub-atmospheric pressure zone 28 and the inner region of the cylinder 16. Upon re-establishing this communication, the air taken into the inner region of the cylinder 16 during the return stroke of the piston 19 is immediately subjected to the sub-atmospheric pressure within the zone 28. The addition of this limited amount of air into the sub-atmospheric pressure zone 28 results in a slight increase of the pressure within the zone 28.

As the pressure within the zone 28 is increased by continual operation of the pistons 19 within the cylinders 16, the water column within the vacuum tank 27 will continue to lower. The larger the vacuum tank 27 is, the less influence the limited amount of air taken into the vacuum tank 27 per cycle will have on the pressure of the sub-atmospheric pressure zone. In other words, the larger the vacuum tank 27, the longer the sub-atmospheric pressure may be maintained within the zone 28. Eventually, the pressure within the zone 28 will approximate atmospheric pressure and the vacuum tank 27 will have to be re-filled with water to evacuate the air and re-create the sub-atmospheric pressure zone 28.

While the preferred embodiment of the present invention has been described, it will be understood that the present invention is limited in scope only by the appended claims.

What is claimed is:

1. A flame-free reciprocating engine which utilizes the pressure difference between a partial vacuum and ambient atmospheric pressure as a source of power, said engine comprising:

a. an engine block defining a plurality of cylinders each having an inner, low pressure end and an outer high pressure end;

b. a plurality of pistons each operating within a different one of said cylinders, each piston having a first face and a second face, said first face operating within an outer region of the respective cylinder which is maintained at atmospheric pressure and said second face operating within an inner region of the cylinder which is sealed from the ambient atmosphere, each of said pistons operating in a reciprocating manner within its respective cylinder between a first position wherein the volume of said inner region is minimized and the volume of said outer region is maximized, and a second position wherein the volume of said inner region is maximized and the volume of said outer region is minimized;

c. output means including an output shaft operatively connected to said pistons for translating the reciprocating motion of said pistons within said cylinders into rotary motion of said output shaft;

d. a flame-free vacuum means for selectively reducing the pressure within the inner region of each cylinder which is adjacent the second face of each piston to a pressure less than atmospheric pressure; and e. means for disconnecting said vacuum means from each cylinder and for permitting the intake of a limited amount of air into the inner region of each cylinder adjacent the second face of each piston, said means operating in timed relation to the operation of said engine such that air intake into each of said inner regions is sufficient to substantially equalize the pressure on both faces of a piston to allow it to be returned to its second position from which it can be driven to its first position by means of a pressure difference across said piston.

2. The engine of claim 1, wherein said vacuum means comprises:

a. a vacuum tank;

b. a water inlet for delivery of water to said vacuum tank;

c. an inlet cutoff valve to close said inlet;

d. a gas outlet position near the top of said vacuum tank to permit the evacuation of air from said tank as said tank is filled with water;

e. a closure valve to close said gas outlet;

f. a water outlet located near the bottom of said vacuum tank to permit the evacuation of water from said tank by force of gravity to thereby create a zone of sub-atmospheric pressure within said tank above the water;

g. an outlet valve to close said water outlet; and h. a plurality of conduits connecting the inner regions of said cylinders with the sub-atmospheric zone of said vacuum tank.

3. The engine of claim 2, wherein said water outlet of said vacuum tank comprises a conduit having a first portion extending downwardly from said vacuum tank and a second portion connected to said first portion oppositely of said vacuum tank and extending upwardly therefrom.

4. The engine of claim 2, wherein said last-mentioned means comprises:

a. a rotating shaft valve interrupting said conduits connecting the inner regions of said cylinders to said vacuum tank, said rotating shaft valve containing a plurality of ports therein to open communication between said inner regions and said vacuum tank when said ports are aligned with said conduits, said rotating shaft valve being operatively connected to said output shaft to rotate in timed relation to the operation of said pistons within said cylinders such that communication between each of said inner regions and said vacuum tank is open as each respective piston operates from said second position to said first position thereby maintaining the pressure on said second face of the piston at less than atmospheric pressure as the piston operates from said second position to said first position; and, b. a plurality of cam-operated air inlet valves, one of said valves being seated within one each of said cylinders, said valve being operatively connected to said output shaft to unseat to permit intake of a limited amount of air into the inner region of each cylinder adjacent the second face of each piston as each piston operates from said first position to said second position thereby maintaining the pressure on said second face of each piston at atmospheric pressure as the piston operates from said first position to said second position.

5. The engine of claim 2, wherein said output means comprises:

a. a plurality of piston rods each attached at a first end to one each of said pistons;

b. a crankshaft having a plurality of throws, each piston rod being attached at a second, opposite end to one each of the throws of said crankshaft;

c. an output shaft operatively connected to said crankshaft and extending exteriorally of said engine block; and d. a flywheel attached to said output shaft.

6. A flame-free reciprocating engine which utilizes the pressure difference between a partial vacuum and the ambient atmospheric pressure as a source of power, said engine comprising:

a. an engine block defining a plurality of cylinders each having an inner, low pressure end and an outer, high pressure end;

b. a plurality of pistons each operating within a different one of said cylinders, each piston having a first face and a second face, said first face operating within an outer region of the respective cylinder which is maintained at atmospheric pressure and said second face operating in an inner region of the cylinder which is sealed from the ambient atmosphere, each of said pistons operating in a reciprocating manner within its respective cylinder between a first position wherein the volume of said inner region is minimized and the volume of said outer region is maximized, and a second position wherein the volume of said inner region is maximized and the volume of said outer region is minimized;

c. a plurality of piston rods attached at a first end to said first face of one each of said pistons;

d. a crankshaft having a plurality of throws, said piston rods being attached at a second, opposite end to one each of the throws of said crankshaft;

e. an output shaft operatively connected to said crankshaft and extending exteriorally of said engine block;

f. a flywheel attached to said output shaft;

g. a vacuum tank having a water inlet for delivery of water to said vacuum tank, an inlet cutoff valve to close said inlet, a gas outlet positioned near the top of said vacuum tank to permit the evacuation of air from said vacuum tank as said vacuum tank is filled with water, a closure valve to close said gas outlet, a water outlet conduit located near the bottom of said vacuum tank to permit the evacuation of water from said vacuum tank by force of gravity to thereby create a zone of sub-atmospheric pressure within said tank above said water, and an outlet valve to close said water outlet;

h. a plurality of conduits connecting the inner regions of said cylinders with the sub-atmospheric zone of said vacuum tank;

i. a rotating shaft valve interrupting said conduits, said rotating shaft valve containing a plurality of ports therein to open communication between said inner regions of said cylinders and said vacuum tank when said ports are aligned with said conduits, said rotating shaft valve being operatively connected to said output shaft to rotate in timed relation to the operation of said pistons within said cylinders such that communication between each of said inner regions of said cylinders and said vacuum tank is open as each respective piston operates from said second position to said first position thereby maintaining a pressure less than the ambient atmospheric pressure upon said second face of the piston as the piston operates from said second position to said first position;

j. a plurality of cam-operated air inlet valves, one of said air inlet valves being seated within one each of said cylinders, to permit the passage of limited amounts of air into said inner regions of said cylinders at predetermined intervals, said air inlet valves operating in timed relation with said rotating shaft valve to permit the intake of air into each of said inner regions only when communication between each respective inner region and said vacuum tank is closed by said rotating shaft valve thereby maintaining said second face of each piston at ambient atmospheric pressure as each piston operates from said first position to said second position.

7. The engine of claim 6, wherein said rotating shaft valve includes a plurality of cam surfaces, one of said cam surfaces being operatively connected to one each of said plurality of air inlet valves.

8. The engine of claim 6, wherein said rotating shaft valve comprises a cylindrical shaft journaled for rotation within said engine block, said cylindrical shaft having a plurality of ports therethrough at right angles to the longitudinal axis of said shaft.

9. The engine of claim 6, wherein said water outlet conduit of said vacuum tank comprises a first portion extending downwardly from said vacuum tank and a second portion connected to said first portion oppositely of said vacuum tank and extending upwardly therefrom.

* * * * *